US005367365A

United States Patent [19]

Haneda et al.

[11] Patent Number: 5,367,365

[45] Date of Patent: Nov. 22, 1994

[54] IMAGE FORMING APPARATUS WITH CHARGER OF IMAGE CARRIER USING MAGNETIC BRUSH

[75] Inventors: Satoshi Haneda; Kunio Shigeta; Sachie Hosokoezawa; Masakazu Fukuchi; Shizuo Morita; Hiroyuki Nomori, all of Hachioji, Japan

[73] Assignee: Konica Corporation, Tokyo, Japan

[21] Appl. No.: 134,981

[22] Filed: Oct. 12, 1993

[30] Foreign Application Priority Data

Nov. 16, 1992 [JP] Japan ..... 4-305565
Nov. 17, 1992 [JP] Japan ..... 4-307050
Nov. 26, 1992 [JP] Japan ..... 4-317350

[51] Int. Cl.[5] ..... G03G 15/02
[52] U.S. Cl. ..... 355/219; 361/225
[58] Field of Search ..... 355/219; 361/221, 225, 361/230

[56] References Cited

U.S. PATENT DOCUMENTS 4,174,903 11/1979 Snelling ..... 355/219

FOREIGN PATENT DOCUMENTS 0474220 9/1991 European Pat. Off. ..... 355/219
59-133569 7/1984 Japan .
63-187267 8/1988 Japan .
4-21873 1/1992 Japan .
4-116674 4/1992 Japan .
5-100545 4/1993 Japan ..... 355/219
5-127490 5/1993 Japan ..... 355/219
5-134517 5/1993 Japan ..... 355/219

OTHER PUBLICATIONS

European Search Report.

*Primary Examiner*—A. T. Grimley
*Assistant Examiner*—William J. Royer
*Attorney, Agent, or Firm*—Frishauf, Holtz, Goodman & Woodward

[57] ABSTRACT

An image forming machine has a charging roller on which magnetic particles are supplied to form a magnetic brush and an image forming body which is charged under the condition that the magnetic brush on the charging roller is in an alternating electric field. When the distance between a regulating member that regulates an amount of the magnetic particles passing through and the charging roller is defined to be DB and the distance between the image forming body and the charging roller is defined to be DI, an inequality of 0.7 DB≦DI≦1.0 DB is satisfied. More preferably, DB is in the relation of 0.2≦DB≦1.0 in mm.

7 Claims, 8 Drawing Sheets

IMAGE FORMING APPARATUS WITH CHARGER OF IMAGE CARRIER USING MAGNETIC BRUSH

BACKGROUND OF THE INVENTION

The present invention relates to an image forming apparatus employing an electrostatic transfer process such as an electrophotographic copying machine, an electrostatic recording apparatus.

For charging an image forming object such as a photoreceptor drum or the like, there has hitherto been used generally a corona charger wherein high voltage is impressed on a discharge wire and thereby a strong electric field is generated around the discharge wire for gaseous discharge. The image forming object is charged when electric charge ions generated in the course of gaseous discharge are adsorbed on the image forming object.

A corona charger used in the conventional image forming apparatus mentioned above has an advantage that an image forming object is not damaged in the course of charging thereon because the charger does not come into mechanical contact with the image forming object. The corona charger, however, has a disadvantage, due to high voltage used therein, that there is a risk of an electric shock or electric leakage and also ozone generated in the course of gaseous discharge is harmful to the human body and the ozone shortens a life of the image forming object. Further, charging voltage by means of a corona charger is sharply influenced by temperature and humidity to be unstable, and noise is caused by high voltage in the corona charger, which is a serious disadvantage on the occasion where an electrophotographic image forming apparatus is utilized as a terminal equipment for communication or an information processing apparatus.

These many disadvantages of a corona charger are caused by gaseous discharge necessary for charging.

Therefore, there are disclosed in Japanese Patent Publication Open to Public Inspection Nos. 133569/1984, 21873/1992 and 116674/1992 (hereinafter referred to as Japanese Patent O.P.I. Publication) the charging devices wherein magnetic particles are adsorbed on a cylindrical conveying carrier which is a charging roller holding therein magnetic objects for forming a magnetic brush, and the magnetic brush rubs the surface of the image forming object for charging it, as a charging device capable of charging the image forming object without conducting high voltage gaseous discharge carried out in a corona discharge and without giving any mechanical damages on the image forming object.

However, even the charging devices disclosed in the aforementioned Japanese Patent O.P.I. Publications have had a problem that an image forming object can not be charged uniformly, completely and stably. Namely, the problem is that when an amount of magnetic particles on the surface of the charging roller is not kept appropriately in the charging area, uneven charging or local excessive charging takes place, or dielectric breakdown of the image forming object caused by bias voltage takes place.

FIG. 5 represents an enlarged schematic view showing a charging section of a conventional charging device wherein magnetic particles 21 on the surface of charging roller 22 form magnetic brush 21A protruded along a line of magnetic force in the form of a chain and bias voltage is impressed by bias power source 24 between image forming object 10 and charging roller 22 for charging through magnetic brush 21A, because a magnetic pole of magnet body 23 affixed inside charging roller 22 that represents the conveying carrier is located in the vicinity of a charging area. In this case, a tip of magnetic brush 21A comes directly into contact with the image forming object 10, resulting in occurrence of local excessive charging, dielectric breakdown of the image forming object 10 and uneven charging thereon, which is a problem. In addition, when the image forming object 10 is subjected to dielectric breakdown in a form of a dot, potential of the total magnetic brushes 21A is lowered through the dot, and there is represented an improper charging area by an area whose width is broader than other areas in a contact strip zone in the direction perpendicular to that of rotation of the image forming object 10 where the magnetic brush 21A is in contact with the image forming object 10.

Further, as described above, there are disclosed in Japanese Patent Publication Open to Public Inspection Nos. 133569/1984 and 187267/1988 the other charging devices wherein magnetic particles are adsorbed on a cylinder holding therein magnetic objects for forming a magnetic brush, and the magnetic brush rubs the surface of the image forming object for charging it, as a charging device capable of charging the image forming object without conducting gaseous discharge carried out in a corona discharge and without giving any mechanical damages on the image forming object.

In the case of charging by means of a magnetic brush, the magnetic brush is caused to make sufficient contact with an image forming object and is caused to rub, and electrons are injected under the condition of relatively high alternating electric field, both for charging the image forming object sufficiently. Due to the high alternating electric field, uneven charging is sometimes caused on the image forming object, or magnetic particles stick to the image forming object. When magnetic particles stick to the image forming object in the course of charging by means of a magnetic brush, uneven toner images are caused in the succeeding process such as imagewise exposure or developing, image quality is disturbed, an image forming object is damaged or an image forming apparatus is deteriorated in terms of its efficiency.

In the technologies disclosed in the aforementioned Japanese Patent O.P.I. Publications, therefore, magnetic particles stuck to an image forming object after charging by means of a magnetic brush are scraped off by a blade brought into contact with the image forming object for scraping after charging, and are collected to the magnetic brush side.

In the method to scrape off magnetic particles sticking to an image forming object by means of a blade, however, there is a fear that damage on the image forming object is rather increased, and in addition, the blade is damaged soon by magnetic particles which are relatively hard and large, which is different from the case of blade-cleaning of toner, and a function of the blade can not be demonstrated sufficiently.

SUMMARY OF THE INVENTION

The first object of the invention is to provide an image forming apparatus wherein neither dielectric breakdown of an image forming object nor occurrence of ozone is caused and extremely stable and uniform charging can be conducted.

The second object of the invention is to provide an image forming apparatus wherein an image forming object can be subjected to necessary charging without being accompanied by occurrence of harmful gas such as ozone or the like, and magnetic particles leaving a magnetic brush and sticking to the image forming object can be collected to the magnetic brush side perfectly, thus an image with high image quality can be obtained stably.

The first embodiment of the invention is represented by an image forming apparatus comprising a charging roller on which magnetic particles are supplied to form a magnetic brush and an image forming object which is charged under the condition that the magnetic brush on the charging roller is in the alternating electric field, wherein, when the distance between a regulating member that regulates an amount of the magnetic particles passing through and the aforementioned charging roller is defined to be DB and the distance between the image forming object and the charging roller is defined to be DI, an inequality of $0.7\ DB \leqq DI \leqq 1.0\ DB$ is satisfied.

In the more preferable embodiment, the DB mentioned above is in the relation of $0.2 \leqq DB \leqq 1.0$ (mm).

In the invention, when the distance between a charging roller for magnetic particles in a charging device of an image forming apparatus and an image forming object is defined to be DI and the distance between a regulating member in the charging device and the charging roller is defined to be DB, regulation is made so that an inequality of $0.7\ DB \leqq DI \leqq 1.0\ DB$ may be satisfied. Therefore, an amount of magnetic particles located at the charging area on the charging roller can be kept appropriately and the charging area can be regulated to be constant accordingly.

The second embodiment of the invention is represented by an image forming apparatus comprising a charging roller on which magnetic particles are supplied to form a magnetic brush and an image forming object which is charged under the condition that the magnetic brush on the charging roller is in the alternating electric field, wherein the image forming object and the magnetic brush move in the same direction at the charging area and their moving speed satisfies the relation of $0.2\ V_I \leqq V_S \leqq 0.9\ V_I$ provided, however, that $V_S$ represents a moving speed of the tip of the magnetic brush on the charging roller and $V_I$ represents a moving speed of the circumferential surface of the image forming object.

Since the moving direction of the magnetic brush at the charging area is arranged to be the same as that of the peripheral movement of the image forming object and the moving speed of the magnetic brush at the charging area is arranged to be lower than the peripheral speed of the image forming object, the difference in speed between them causes the tip of the magnetic brush to be bent in the moving direction of the image forming object so that the tip of the magnetic brush may not be in direct contact with the image forming object and the charging area may be broadened accordingly.

The third embodiment of the invention is represented by an image forming apparatus comprising a charging means through which an image forming object is charged by rubbing action of a magnetic brush composed of magnetic particles, wherein the charging means is provided with a charging member located at the upstream side of the image forming object in terms of its moving direction and with a magnetic particle collecting member located at the downstream side, and the charging member is impressed with D.C. voltage and A.C. voltage that is superimposed on the D.C. voltage to form an alternating electric field, while the magnetic particle collecting member is impressed with D.C. voltage identical to that impressed on the charging member, or the collecting member is made to be in a floating state, or it is made to be an insulating object.

In an image forming apparatus of the invention, relatively high A.C. bias voltage is impressed on a charging member so that an image forming object may be charged efficiently, and in that case, magnetic particles vibrating at an exit of the charging member are set free from magnetic restriction of the charging member and are stuck to the image forming object.

In the invention, therefore, a charging member and a magnetic particle collecting member located at the downstream side of the charging member are compacted in one casing as a charging device, and magnetic particles caused by the charging member are adsorbed magnetically by the magnetic particle collecting member and are collected into the charging device perfectly.

The charging device related to the invention consists of a magnetic particle charging roller composed of magnetic objects and a sleeve rotating relatively around the magnetic objects and of magnetic brushes formed on the sleeve. The distance D between the sleeve of the magnetic brush charging member and an image forming object is made to be within a range of 0.1–5 mm. D.C. voltage ±500–1000 V and A.C. voltage with frequency of 0.2–5 kHz and $V_{p\text{-}p}$ 200–3500 V 0.3–10 kHz are impressed across the distance D on a superposed basis, thus there is formed an alternating electric field which cause charges to be injected from the magnetic brush into the image forming object for charging.

With regard to the magnetic particle collecting member related to the invention, it may also be a magnetic brush collecting member consisting of a magnetic particle charging roller composed of magnetic objects and a sleeve rotating relatively around the magnetic objects similarly to the aforementioned charging member and of magnetic brushes formed on the sleeve. It may also be composed of roll-shaped magnetic objects which are in contact with an image forming object to be rotated (or to be rotated forcibly).

In any of the magnetic brush collecting member and the magnetic object collecting member, it is possible to collect magnetic particles sticking to the surface of an image forming object by rubbing or by being in contact with the surface of the image forming object and to offer the uniform charging by correcting uneven charging caused in the course of charging by means of charging member. In this case, the collecting member is impressed only with D.C. voltage. Therefore, charged given by the charging member previously are not disturbed, uneven charging can further be corrected and magnetic particles are prevented completely from sticking to the image forming object again.

Further, the collecting member mentioned above may also be arranged so that it is electrically isolated without being impressed with D.C. voltage, namely it is in the floating state, thereby it does not form an electric field between itself and an image forming object, and it only collects magnetic particles sticking to the surface of the image forming object.

In this case, sticking magnetic particles are collected through the function of magnetic force of the collecting member, while charges given by the charging member are not disturbed.

Furthermore, the collecting member may also be an insulating object such as an insulating and magnetic object or an insulating sleeve, for example, or the magnetic object or the sleeve may be covered with an insulating layer. Even in that case, no electric field is formed between itself and an image forming object, thereby charges given by the charging member are not disturbed, and only collection of magnetic particles through the magnetic force of the collecting member can be made.

Incidentally, in the preferred embodiment of a charging device of the invention, the width through which the magnetic particle collecting member is in contact with the image forming object is made greater than that for the charging member mentioned above for the purpose to improve the efficiency of collecting magnetic particles sticking to the image forming object, and in addition, the magnetic force of the magnetic particle collecting member is made to be greater than that for the occasion of the charging member mentioned above. Namely, the clearance between the collecting member and the image forming object is made smaller than that between itself and the charging member, or the diameter of the collecting member is made greater to realize the greater width for contacting the image forming object. It is further possible to improve the efficiency of collecting magnetic particles by enhancing the magnetic force on the surface with the intensity of magnetism that is greater for the collecting member that for the charging member.

DETAILED DESCRIPTION OF THE PREFERRED EMBODIMENTS

Figure 1:
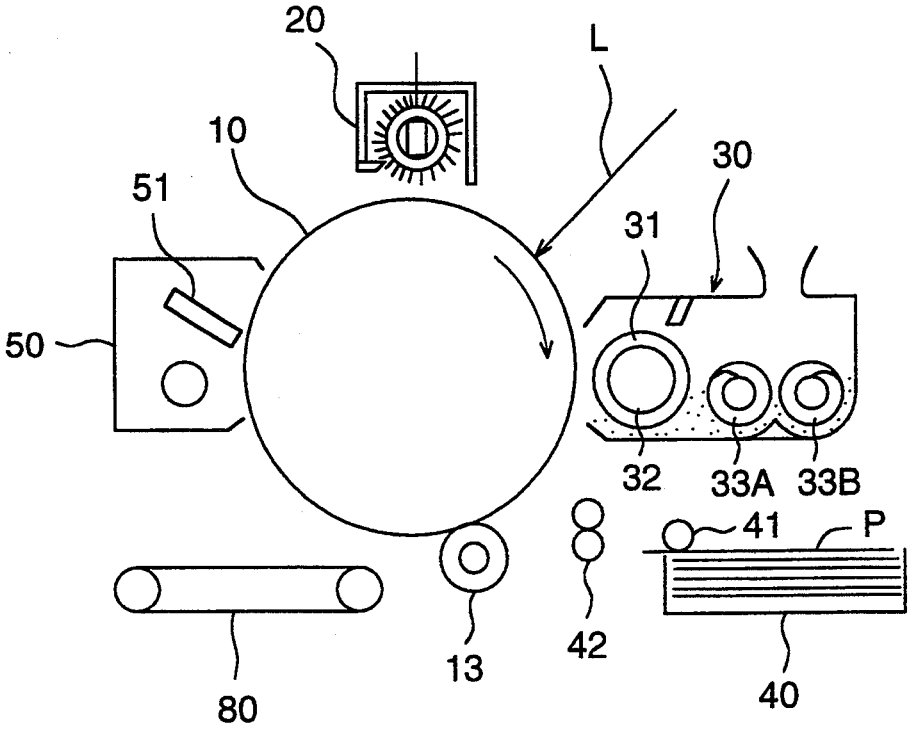
FIG. 1 is a schematic view showing the outline of the structure of an image forming apparatus of the invention.

Before explaining examples of the invention, a particle size of a magnetic particle and conditions of a charging roller will be explained as follows.

Generally, when an average particle size weighted mean of magnetic particles is large, a magnetic brush formed on a charging roller shows its coarse structure. Therefore, even when charging while giving vibration with an electric field, the magnetic brush tends to show unevenness, resulting in a problem of uneven charging. In order to solve the problem, an average particle size of magnetic particles is required to be small, and results of experiments have shown that the average particle size of not more than 150 μm starts indicating its effect, and that of not more than 100 μm does not cause the problem mentioned above substantially. However, when particles are too small, they stick to the surface of an image forming object during the course of charging, or they easily scatter. These phenomena are observed remarkably in general when an average particle size is not more than 30 μm, though the phenomena depend on the intensity of a magnetic field, or then intensity of magnetization of particles caused by the intensity of the magnetic field. Incidentally, the intensity of magnetization ranging from 20 emu/g to 200 emu/g is preferably used.

From the foregoing, it is preferable that a particle size of a magnetic particle with regard to a particle size of a magnetic particle, the foregoing shows that the average particle size weighted mean of not more than 150 μm is preferable and that of not more than 100 μm and not less than 30 μm is especially preferable.

The magnetic particles as those mentioned above are obtained by selecting particle sizes through the average particle size selecting means known widely in the past from the particles of ferromagnetic substance such as metal including iron, chromium, nickel or cobalt identical to those in magnetic carrier particles in the conventional two-component developer, or such as a compound or an alloy thereof including, for example, triiron tetroxide, r-ferric oxide, chromium dioxide, manganese oxide, ferrite, or manganese-copper alloy, or from the particles obtained either by covering the surface of the ferromagnetic substance particle mentioned above with resins such as styrene resin, vinyl resin, ethylene resin, rosin-denatured resin, acrylic resin, polyamide resin, epoxy resin or polyester resin, or by preparing with resins containing dispersed magnetic substance fine particles.

A magnetic particle formed to be spherical offers an effect that a uniform particle layer can be formed on a charging roller and high bias voltage can be impressed uniformly on the charging roller. Namely, the magnetic particle formed to be spherical offers the following two effects: (1) though a magnetic particle tends to be adsorbed magnetically in its major axis direction, the spherical particle does not have any tendency in terms of direction of magnetic adsorption, and thereby a layer can be formed uniformly and occurrence of an area where the resistance is locally lower and unevenness of the layer thickness can be prevented, and (2) resistance of a magnetic particle is enhanced and the particle loses its edge portion observed on a conventional particle, thereby electric fields are not concentrated on the edge portion, resulting in uniform discharging on an image forming object and no occurrence of uneven charging despite impression of high bias voltage on a magnetic particle charging roller.

As the spherical particles exhibiting the effects mentioned above, those wherein conductive magnetic particles are formed so that electrical resistivity may show the value of not less than $10^3$ Ω·cm and not more than $10^{12}$ Ω·cm, especially the value of not less than $10^4$ Ω·cm and not more than $10^9$ Ω·cm are preferable. This electrical resistivity represents a value obtained by reading a value of an electric current when particles are put in a container having a cross-sectional area of 0.50 $cm^2$, then are tapped, load of 1 $kg/cm^2$ is applied on the crammed particles and voltage is impressed between the load and an electrode on the bottom of the container so that an electric field of 1,000 V/cm may be formed.

Under the condition of low electrical resistivity, when bias voltage is impressed on a charging roller, electric charges are injected in magnetic particles and thereby the magnetic particles tend to stick to the charging roller, or dielectric breakdown of an image forming object caused by bias voltage tends to take place. When the electrical resistivity is high, on the contrary, no electric charges are injected and no charging is made accordingly.

With regard to magnetic particles used in the invention, the preferable ones have small specific gravity and appropriate maximum magnetization so that a magnetic brush composed of the magnetic particles may move lightly owing to an alternating electric field and yet no scattering of the magnetic particles may occur. It has been found out that the magnetic particles whose true specific gravity is not more than 6 and maximum magnetization is 30–100 emu/g produce good results actually.

Putting the foregoing together, optimum conditions of the magnetic particles include that a particle is made globular so that the ratio of the major axis to the minor axis of the particle is not more than 3, an acicular portion and an edge portion of the particle have no protrusions and electrical resistivity is preferably not less than $10^4$ Ω·cm and not more than $10^9$ Ω·cm. The magnetic particles having the optimum conditions mentioned above can be manufactured by selecting the spherical particles to the utmost, and by providing a spheroidizing process after formation of dispersed resin particles by using magnetic substance fine particles to the utmost in the case of particles wherein magnetic substance fine particles are dispersed, or by forming dispersed resin particles through the method of spray drying.

Further, when toner is mixed in a magnetic brush, charging efficiency is lowered and thereby uneven charging takes place because insulating power of the toner is high. For avoiding this problem, it is necessary to reduce an amount of charges on the toner so that the toner may move to an image forming object in the course of charging. It was possible to prevent toner accumulation on a magnetic brush when an amount of frictional electrification of toner was made to be 1–20 μC/g in the same charging polarity under the condition that toner was mixed with magnetic particles and adjusted to the toner concentration of 1%. It is considered that the reason for the above is that the toner, even when it is mixed, sticks to a photoreceptor in the course of charging. It was confirmed that when an amount of charges of toner is large, it is difficult for the toner to leave magnetic particles, while when that is small, it is difficult to move electrically to an image forming object.

The foregoing represents the conditions of magnetic particles, and conditions of magnetic particles forming a particle layer and thereby charging an image forming object in relation to a charging roller will be explained as follows.

With regard to a charging roller for magnetic particles, a conductive charging roller capable of being impressed with bias voltage is used, and especially, the one wherein a magnetic object having plural magnetic poles is provided inside a conductive charging roller having on its surface a particle layer, is preferably used. In such charging roller as mentioned above, fresh magnetic particles are supplied in succession because a particle layer formed on the surface of the conductive charging roller due to the relative rotation to the magnetic object moves with a wavy movement, and even when slight unevenness in thickness of a layer exists in a particle layer on the surface of the charging roller, the effect of the unevenness can be offset sufficiently by the wavy movement mentioned above so that no problem may be caused practically. The conveyance speed for magnetic particles caused by a rotation of the charging roller may be slower than the moving speed of an image forming object, but it is preferable that the conveyance speed is either equivalent mostly to or higher than the moving speed of an image forming object. With regard to the conveyance direction caused by a rotation of the charging carrier, the same direction is preferable. The uniform charging under the condition of the same direction is superior to that under the condition of the opposite direction.

With regard to the surface of a charging roller, mean roughness of 20–40 μm is preferable, more preferably 10–25 μm, for stable and uniform conveyance of magnetic particles. When the surface is too smooth, magnetic particles can not be conveyed sufficiently and when it is too rough, excess current flows from the protrusion on the surface. In any case, sand blasting process that tends to cause uneven charging is preferably used.

Further, it is preferable that the thickness of a particle layer formed on a charging roller is uniform. When an amount of magnetic particles existing in a charging area on the surface of the charging roller is large, the magnetic particles can not be vibrated sufficiently, causing abrasion of a photoreceptor and uneven charging, and excess current tends to flow while the torque for driving the charging roller is increased, which is a disadvantage. When an amount of magnetic particles existing in a charging area on the surface of the charging roller is small, on the contrary, a portion of imperfect contact with an image forming object is created, causing magnetic particles to stick to the image forming object and uneven charging to take place. It was found out, after some experiments, that the preferable amount W of magnetic particles existing in the charging area is 10–300 mg/cm$^2$ and the more preferable is 30–150 mg/cm$^2$. Incidentally, this existing amount represents a mean value in the contact area of a magnetic brush.

The distance between a charging roller and an image forming object which is 0.1 mm–10 mm is preferable, and the more preferable is 0.2 mm–5 mm. When the distance DI between a charging roller and an image forming object is smaller than 0.2 mm, it is difficult to form an ear of a magnetic brush that conducts uniform charging operation for the distance, and it is impossible to supply sufficient magnetic particles to the charging section, making it impossible to charge stably. When the distance DI exceeds 5 mm by far, a particle layer is formed coarsely, causing uneven charging to take place easily and causing sufficient charging not to be obtained by reducing the charge injection efficiency. When the distance DI between a charging roller and an image forming object takes an extreme value as shown above, the thickness of a particle layer on the charging roller can not be adjusted to the appropriate value for the distance. When the distance DI is in the range of 0.1–5 mm, however, it is possible to make the thickness of a particle layer to be appropriate for the distance so that occurrence of comet caused by rubbing of a magnetic brush may be prevented. It was further clarified that most preferable conditions exist between the appropriate conveyance amount (W) and distance Conditions of $300 \leqq W/DI \leqq 3{,}000$ (mg/cm$^3$) were important for charging uniformly, at high speed and stably. When the value of W/DI was out of this range, it was confirmed that uneven charging took place.

A diameter of the charging roller ranging from 5 mm $\phi$ to 20 mm $\phi$ is preferable. With the diameter in that range, it is possible to secure a contact area necessary for charging. When the contact area is larger than that is needed, charging current is increased to be excessive, while when it is smaller than is needed, uneven charging tends to occur.

When a small diameter is employed as described above, it is preferable to reduce the linear speed of a charging roller because magnetic particles tend to scatter or tend to stick to an image forming object due to the centrifugal force.

DI is considered to be a factor for determining the length of a chain of magnetic particles. Electric resistance corresponding to the length of the chain is considered to correspond to easiness of charging and charging speed. On the other hand, W is considered to be a factor determining the density of chains of magnetic particles. It is considered that an increase of the number of chains improves uniformity of charging. In a charging area, however, it is considered that compressed state of chains of magnetic particles is realized when the magnetic particles pass through a narrow gap. In this case, the chains of magnetic particles rub an image forming object while the chains contact each other to be bent and disturbed.

The disturbing conditions are considered to cause no charging streaks and to make the movement of charges easy, thereby to be effective for uniform charging. Namely, when the value of W/DI corresponding to magnetic particles density is small, chains of magnetic particles are coarse to receive less disturbance, resulting in uneven charging. When the value of W/DI is large, chains of magnetic particles are not formed sufficiently due to the high degree of packing, and magnetic particles are less disturbed. This prevents the free movement of charges and is considered to be the reason for uneven charging.

Incidentally, when the conveyance amount W is smaller than 10 mg/cm$^2$, sticking of magnetic particles and uneven charging are caused, while when W is larger than 300 mg/cm$^2$, abrasion of a photoreceptor and uneven charging are caused, both of the foregoing failed to offer preferable results. The preferable range between the both cases above was 30–150 mg/cm$^2$.

Further, it was clarified that the more preferable uniform charging free from sticking of magnetic particles and uneven charging can be obtained when W/DI is set, under the aforementioned condition of conveyance amount, to the conditions of 300 mg/cm$^3$ $< W/DI <$ 3,000 mg/cm$^3$ wherein the distance between an image forming object and a charging roller of magnetic particles is defined to be DI (cm). When the value of W/DI was made smaller than 300 mg/cm$^3$, or larger than 3,000 mg/cm$^3$, there were observed phenomena including sticking of magnetic particles and occurrence of uneven charging.

From the foregoing, preferable conditions are as follows: a magnetic brush composed of a layer of magnetic particles sticking to a charging roller for magnetic particles having magnetic force is brought into contact with a moving image forming object, a bias electric field is formed between the charging roller and the image forming object, and thereby an alternating electric field is used for the bias electric field, the magnetic brush is formed so that an existing amount of magnetic particles at a charging area may be 10–300 mg/cm$^2$ and further the conditions of $300 \leqq W/DI \leqq 3{,}000$ (mg/cm$^3$) wherein DI (cm) represents the distance between the charging roller for magnetic particles and the image forming object are satisfied, in a charging device for charging an image forming object.

EXAMPLES

Examples of the invention will be explained as follows, referring to the drawings.

FIG. 1 is a sectional view showing the outline of the structure of an electrostatic recording apparatus that is an image forming apparatus of the invention. In the figure, the numeral 10 represents an image forming object that rotates in the arrowed direction (clockwise), namely a photoreceptor drum composed of OPC charged negatively. Around the circumference surface of the photoreceptor drum, there are provided charging device 20 which will be described later, an exposure unit where image light L from an exposure device enters, developing unit 30, transfer roller 13 and cleaning unit 50.

In the basic operation of a copy process of the present example, when a command to start copying is sent from an unillustrated operation panel to an unillustrated control unit, photoreceptor drum 10 starts rotating in the arrowed direction, being controlled by the control unit. When the photoreceptor drum 10 rotates, the circumference surface thereof passes through charging device 20 described later to be charged uniformly. On the surface of the photoreceptor drum 10, there is written an image with image light L, such as a laser beam, for example, from an image writing device, thus, an electrostatic latent image corresponding to the image is formed.

In developing unit 30, there are contained two-component developers which are stirred by stirring screws 33A and 33B and then adhere to the external surface of developing sleeve 31 which is positioned to cover magnetic object roller 32 and rotates to form a magnetic brush of developers. On the developing sleeve 31, there is impressed predetermined bias voltage so that reversal development may be conducted at the developing area facing the photoreceptor drum 10.

Recording sheets P are fed out from sheet-feeding cassette 40 by first sheet-feeding roller 41 one sheet by one sheet. The recording sheet P thus fed out is sent onto photoreceptor drum 10 by second sheet-feeding roller 42 that operates in synchronization with the aforementioned toner image on the photoreceptor drum 10. Then, the toner image on the photoreceptor drum 10 is separated from the photoreceptor drum 10 and transferred onto the recording sheet P through the operation of transfer roller 13. The recording sheet P onto which the toner image has been transferred is sent, through conveyance means 80, to an unillustrated fixing unit where the recording sheet is sandwiched between a heat-fixing roller and a pressure roller to be fixed, and then is ejected to the outside of an apparatus. The surface of the photoreceptor drum 10 having thereon toner which stays there without being transferred onto the recording sheet P is scraped by cleaning unit 50 equipped with blade 51 or the like for cleaning to be standing by ready for the following copying.

Figure 2:
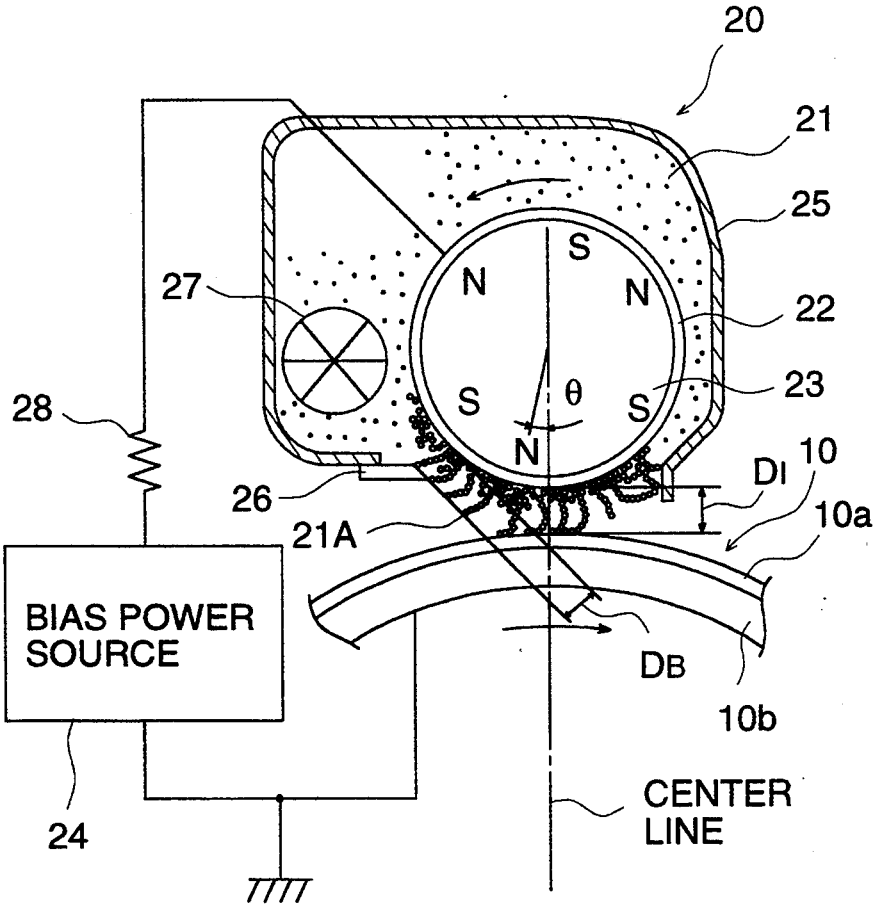
FIG. 2 is a schematic view showing an example of the charging device in FIG. 1.

FIG. 2 represents a sectional view showing an example of charging device 20 used for the image forming apparatus in FIG. 1. In the figure, the numeral 21 represents magnetic particles, 22 represents a charging roller that is a carrier for conveying magnetic particles 21 formed with non-magnetic and conductive metal such as, for example, sandblasted aluminum having the surface roughness of 7 μm, and 23 represents a columnar magnetic object affixed inside the charging roller 22. Around the circumference of the columnar magnetic object 23, there are arranged south poles and north poles as shown in the figure so that the surface of the charging roller 22 may show 500–1,000 gauss, and thereby the columnar magnetic object is magnetized. Let it be assumed that a magnetic pole in a charging area closest to the photoreceptor drum 10 among other magnetic poles is called a primary magnetic pole. It was found out to be preferable that the primary pole is at the position where the charging roller 22 is closest to the photoreceptor drum 10, namely the position in the vicinity of the center line connecting the center of the photoreceptor drum 10 and that of the charging roller 22, and angle $\theta$ formed by the straight line connecting the center of the charging roller 22 and the magnetic pole and by the center line mentioned above is in the range of $-15° \leqq \theta \leqq 15°$ after experiments.

The numeral 25 represents a casing that forms a reservoir portion for the aforementioned magnetic particles 21, and inside the casing 25, there are provided the aforementioned charging roller 22 and magnetic object 23. At the outlet of the casing 25, there is provided non-magnetic regulating plate 26 that is a regulating member for regulating the throughput of the magnetic particles 21 so that the thickness of the magnetic particles 21 sticking to the charging roller 22 to be carried out may be regulated. Distance DB between the regulating plate 26 and the charging roller 22 is set to be not less than 0.2 mm and to be not more than 1.0 mm, and the charging roller 22 can rotate around the magnetic object 23. Distance DI between the charging roller 22 and the photoreceptor drum 10 at the position where the charging roller faces the photoreceptor drum 10 is kept to be 0.7 DB–1.0 DB, namely kept within a range of $0.7\ DB \leqq DI \leqq 1.0\ DB$, and the charging roller 22 is rotated in the same direction as in the moving direction of the photoreceptor drum 10 preferably at the peripheral speed which is 1.2 times–2.0 times that of the image forming object, though it may be rotated more slowly than the image forming object.

As a result, it can be adjusted so that a conveyance amount of magnetic particles 21, namely an existing amount of magnetic particles 21 in the charging area on the charging roller 22 may be 10–300 mg/cm$^2$. Distance DI between the photoreceptor drum 10 and the charging roller 22 is filled with thickness-regulated magnetic brush 21A composed of magnetic particles 21. Agitating plate 27 is a rotary object having around its axis plate-shaped members which correct the unbalanced magnetic particles 21.

The photoreceptor drum 10 consists of conductive base 10*b* and photoreceptor layer 10*a* that covers the conductive base 10*b* which is grounded.

The numeral 24 is a bias power source that applies bias voltage between the charging roller 22 mentioned above and the conductive base 10*b*, and the charging roller 22 is grounded through the bias power source 24.

The bias power source 24 is a power source to supply A.C. bias voltage wherein A.C. components are superposed on D.C. components set to the same value as that of voltage used for charging. DI is kept within 0.2–1.0 mm though it depends on the dimension of the distance DI between the charging roller 22 and the photoreceptor drum 10 and on charging voltage with which the photoreceptor drum 10 is charged. It was possible to obtain preferable charging conditions by supplying, through protective resistance 28, the A.C. bias voltage wherein A.C. components of 200–3,500 V and 0.3–10 KHz are superposed, as peak-to-peak voltage ($V_{p\text{-}p}$), on D.C. components of −500 V−−1,000 V which are mostly the same as voltage for charging. Incidentally, in the bias power source 24, D.C. components are subjected to constant-voltage control, while A.C. components are subjected to constant-current control.

Operations of the charging device 20 described above will be explained as follows.

When the charging roller 22 is rotated in the arrowed direction at the speed ranging from 1.2 times to 2.0 times that of the peripheral speed of the photoreceptor drum 10, while the photoreceptor drum 10 is being rotated in the arrowed direction, layers of magnetic particles 21 attracted by lines of magnetic force of magnetic object 23 to and conveyed by the charging roller 22 are connected magnetically to the shape of a chain to be a sort of brush shape at the location on the charging roller 22 where the charging roller faces the photoreceptor drum, thus the so-called magnetic brush 21A is formed. The magnetic brush 21A is conveyed in the direction of the rotation of the charging roller 22 to come in contact with photoreceptor layer 10*a* on the photoreceptor drum 10 to rub it. Since A.C. bias voltage mentioned above is impressed between the charging roller 22 and the photoreceptor drum 10, charges are injected in the photoreceptor layer 10*a* to charge it through conductive magnetic particles 21. In this case, in particular, A.C. bias voltage is impressed for forming alternating electric field, distance DB between the aforementioned regulating plate 26 and the charging roller 22 is set to be not less than 0.2 run and to be not more than 1.0 mm, and distance DI at the position for facing the photoreceptor drum 10 is regulated to be 0.7 DB −1.0 DB. Therefore, an amount of magnetic particles 21 at the charging area can be kept appropriately, and it is possible to improve efficiency for injecting charges from the magnetic brush 21A, to make the charging area appropriate and to conduct charging which is extremely stable, high speed and uniform without unevenness.

Figure 3:
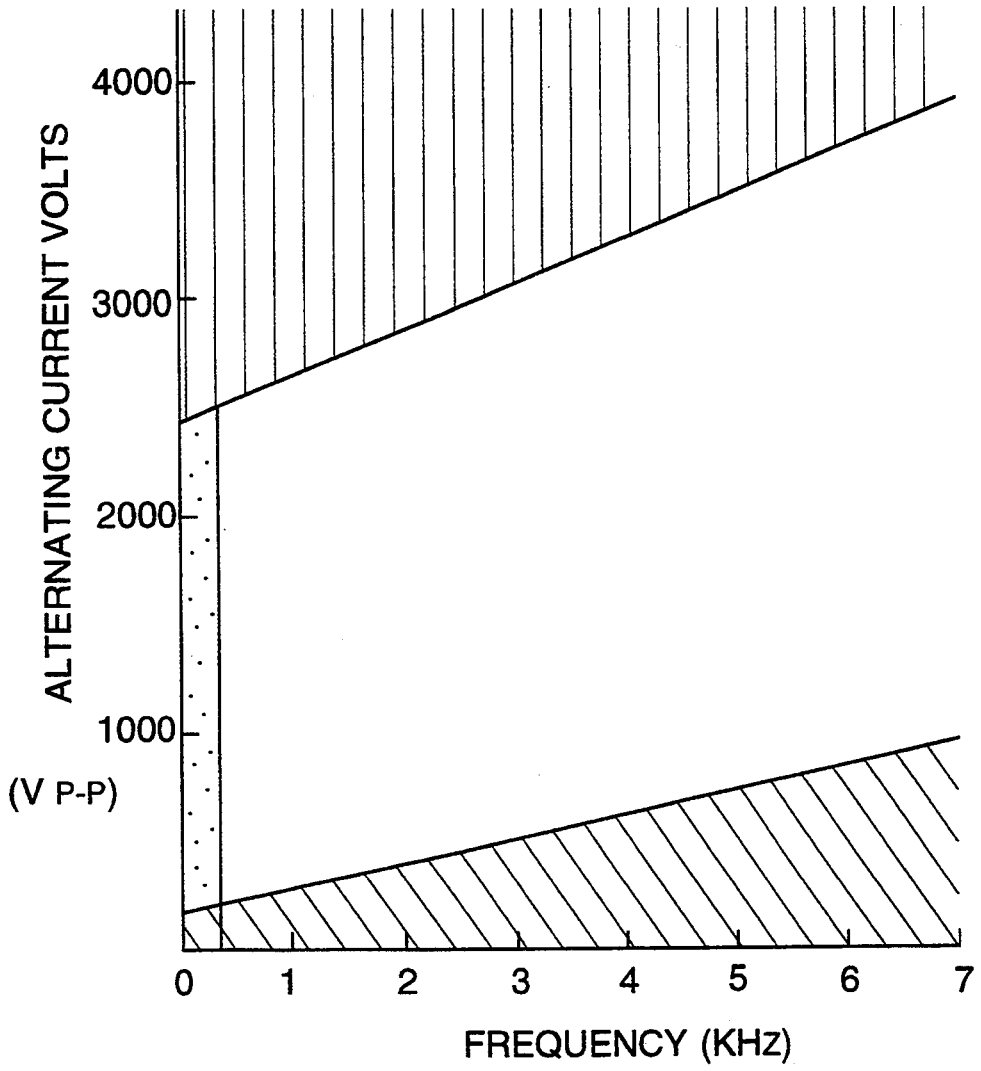
FIG. 3 is a diagram of charging characteristics for the variation of frequency and voltage in A.C. voltage component.

Incidentally, FIG. 3 shows the results of the above-mentioned example wherein both frequency and voltage of A.C. voltage components to be impressed on charging roller 22 were varied.

In FIG. 3, a portion hatched with vertical lines represents a zone where dielectric breakdown tends to take place, a portion hatched with slanting lines represents a zone where uneven charging tends to take place, and a portion which is not hatched represents a preferable zone where charging can be conducted stably. As is apparent from the figure, the preferable zone varies slightly depending on variation of A.C. voltage components. Incidentally, a waveform of A.C. voltage component may also be a square wave or a triangular wave, without being limited only to a sine wave. Further, in FIG. 3, a dotted area of low frequency is a zone where uneven charging is caused due to a low frequency.

Spherical ferrite particles coated to be conductive were used as magnetic particles 21 in the example mentioned above. In addition to that, it is also possible to use conductive magnetic resin particles obtained by crushing primary components of magnetic particles and resins together after thermal refining thereof. For excellent charging, each particle is required to be prepared to satisfy that the external shape of each particle is truly spherical, particle size is 50 μm, specific resistance is $10^3$ Ω·cm, and an amount of frictional electrification is −5 μC/g under the condition of toner concentration of 1%.

Incidentally, it is further possible to neutralize photoreceptor drum 10 by the use of charging device 20 of the present example. Neutralizing can be carried out by bias voltage wherein only D.C. components are reduced to zero. After forming an image, an image forming object is rotated while it is being impressed with only A.C. components, thus, photoreceptor drum 10 can be neutralized. When impression of A.C. components is either stopped upon completion of neutralization of the photoreceptor drum 10, and the direction of north—south poles of magnetic object 23 is made parallel to a tangent at the point where the magnetic object faces the photoreceptor drum 10, magnetic brush 21A parallels, owing to a horizontal magnetic field, the tangent at the point where the magnetic object faces the photoreceptor drum 10. Therefore, the tip of the magnetic brush 21A can leave the photoreceptor drum 10 without making magnetic particles 21 stick to the circumferential surface of the photoreceptor drum 10.

In the image forming method wherein the charging device mentioned above is used as a cleaning unit, reversal development is more preferable than regular development. The reasons for that are as follows: toner tends to be ejected from the charging device in the course of charging, ejected toners have the same polarity in the course of reversal development and are collected by developing bias at the developing section, thus, fogging of images can be prevented.

Incidentally, after a long term use, much toner staying on the surface of the photoreceptor drum 10 without being cleaned is mixed in a layer of magnetic particles 21. This sometimes causes the resistance of the magnetic brush 21A to be enhanced, resulting in deteriorated charging efficiency. For the foregoing, it is possible to prevent the toner mixing by establishing the conditions under which toner tends to stick to photoreceptor drum 10, including setting to the high level the polarity of D.C. bias voltage to be impressed on charging roller 22 while the photoreceptor drum 10 is rotating before or after image forming, or setting the A.C. voltage to the high level. Especially in the case wherein the charged polarity on the photoreceptor drum 10 is identical to that of toner as in an image forming apparatus conducting reversal development, the polarity is the same as that of toner contained in developing unit 30. Therefore, contamination caused by toner tends not to occur, resulting in no appearance of fog on an image in the course of developing, proving to be an optimum combination.

With regard to a charging roller for the magnetic brush 21A, it is not limited only to the structure of charging roller 22 having therein magnetic object 23, but it may also be one which is composed only of rotary magnetic object 23 magnetized alternately to north and south without having charging roller 22.

In the invention, an image forming object is charted through a magnetic brush formed on a charging roller that injects charges directly into the image forming object. Therefore, it is possible to lower bias voltage and thereby to prevent generation of ozone. Further, distance DB between the aforementioned regulating member and the charging roller is established to be not less than 0.2 mm and not more than 1.0 mm, the value of distance DI between the charging roller and the image forming object at the point where they face each other is regulated to be 0.5 times–0.9 times that of DB, and an alternating electric field is formed between the magnetic brush mentioned above and the image forming object as bias voltage. Therefore, it is possible to provide an image forming apparatus wherein an amount of magnetic particles forming the aforementioned magnetic brush located at the charging area can be maintained appropriately, occurrence of clogging of magnetic particles can be prevented and unnecessary spread of charging area and occurrence of excess current are prevented, and dielectric breakdown of an image forming object and sticking of magnetic particles to the image forming object are prevented, thus, extremely stable and uniform charging that is free from uneven charging can be carried out.

Figure 4:
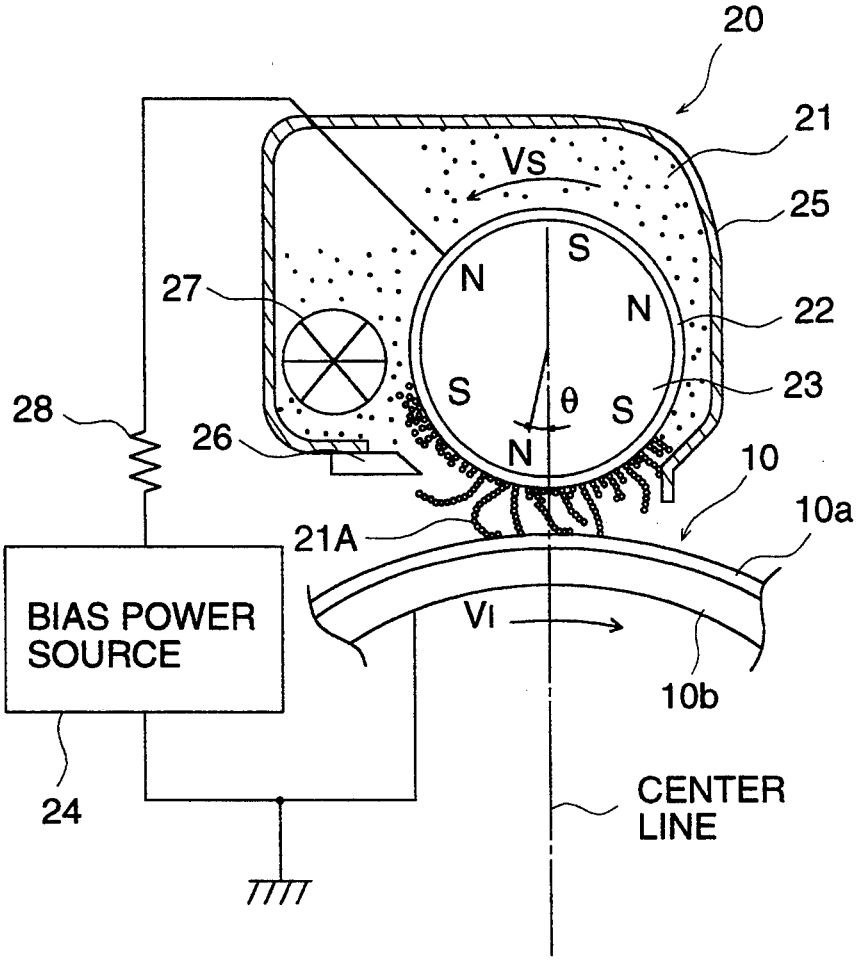
FIG. 4 is a sectional view showing another example of the charging device in FIG. 1.
Figure 5:
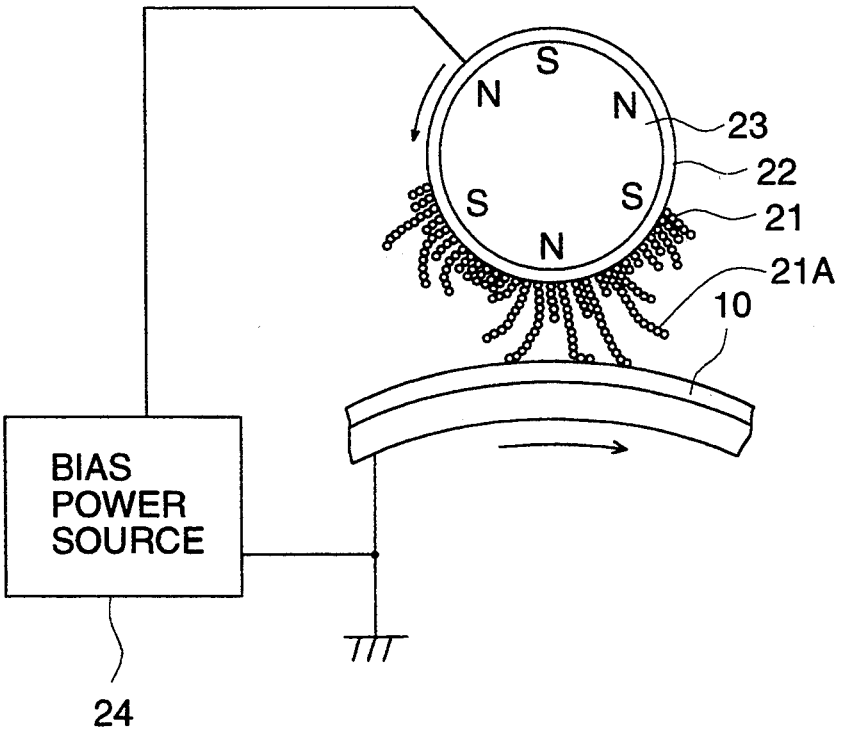
FIG. 5 PRIOR ART
FIG. 5 is an enlarged schematic view showing the charging area of a conventional charging device.

FIG. 4 represents a sectional view showing another example of charging device 20 used in the image forming apparatus shown in FIG. 1. It is mostly the same in terms of structure as that shown in FIG. 2, and the different points only will be explained as follows. Charging roller 22 is arranged to be capable of rotating relatively to magnetic object 23, it is kept to be away from photoreceptor drum 10 by the distance of 0.2–1.0 mm at the position where it faces the photoreceptor drum 10, and it is rotated so that the moving direction of the tip of the magnetic brush 21A in the charging area may be identical to that of the photoreceptor drum 10 and the speed thereof may be 0.5–0.9 times that of the peripheral speed of the photoreceptor drum 10. Namely, when $V_S$ represents the moving speed of the tip of the magnetic brush 21A on the charging roller 22, and $V_I$ represents the moving speed of the circumference surface of the photoreceptor drum 10, the condition of $0.2\ V_I \leqq V_S \leqq 0.9\ V_I$ makes the tip of the magnetic brush 21A to be bent for excellent charging and prevents scattering of magnetic particles and sticking thereof to the image forming object.

When $V_S$ is large, problems of scattering and sticking of the magnetic particles tend to be caused, while, when $V_S$ is small, uneven charging in the form of streaks tends to occur. The preferable condition of the $V_S$ is represented by $0.3\ V_1 \leqq V_S \leqq 0.5\ V_1$.

Operations of the charging device 20 mentioned above will be explained next, as follows. Since the A.C. bias voltage is impressed between charging roller 22 and photoreceptor drum 10, electric charges are injected onto photoreceptor layer **10*a* through magnetic particles 21, thus, charging with electricity is carried out. In this case, in particular, charging efficiency is improved and the rate of occurrence of dielectric breakdown of the photoreceptor drum 10 caused by bias voltage is reduced due to the alternate electric field formed by impressing A.C. bias voltage and to the extended area of contact of magnetic brush 21A with the photoreceptor drum 10 created by the tip of the magnetic brush that is bent through the difference of speed between the peripheral speed of the photoreceptor drum 10 and the moving speed of the tip portion of the magnetic brush 21A which is slower. Stirring plate 27 is a rotary object wherein a plate-shaped member correcting biased magnetic particles 21** is provided around the shaft.

Incidentally, with regard to a charging roller for the magnetic brush 21A, it is not limited only to the structure of charging roller 22 having therein magnetic object 23, but if may also be one which is composed only of rotary magnetic object 23 magnetized alternately to north and south without having charging roller 22. The peripheral speed of the magnetic object 23, in this case, is naturally arranged so that the moving speed of the tip portion of the magnetic brush 21A may be 0.2–0.9 times that of the photoreceptor drum 10.

Since an image forming object is charged with electricity through direct injection of electric charges therein made by a magnetic brush formed on a charging roller in the invention, it is possible to use lower bias voltage and thereby to prevent occurrence of ozone. Further, an alternating electric field is formed as a bias electric field between the magnetic brush mentioned above and the image forming object, the moving direction of the charging roller and that of the image forming object both in a charging area are caused to be the same, and the magnetic brush is caused to move at the speed that is 0.2–0.9 times that of the peripheral speed of the image forming object. Therefore, it is possible to provide an image forming apparatus wherein the tip portion of the magnetic brush is bent to expand its area of contact with the image forming object without contacting the image forming object directly, resulting in a fall of the occurrence rate of dielectric breakdown of the image forming object, prevention of occurrence of defectively charged portions and in an improvement of efficiency for injecting charges from the magnetic brush, thus, uniform charging without unevenness can be performed at high speed extremely stably.

Next, a magnetic object that holds and carries a magnetic particles layer of a charging member and a charging roller for magnetic particles composed of a sleeve will be explained as follows. The magnetic object has therein a plurality of alternate north-south magnetic poles and a layer of particles formed on the surface of the sleeve is moved in a wavy motion by the relative rotation between the magnetic object and the sleeve. Therefore, fresh magnetic particles are supplied in succession, and an effect of slight unevenness in the layer thickness of the layer of particles on the surface of the sleeve can be covered by the wavy movement mentioned above so that it may cause no problem practically. It is preferable that the speed for transporting magnetic particles caused by rotation of the sleeve or further by rotation of the magnetic object is mostly the same as or higher than the moving speed of the image forming object. It is further preferable that the transport direction caused by rotation of the sleeve is in the same direction. Uniformity of charging is better in the case of the same direction than in the case of the opposite direction. The invention, however, is not limited only to that.

Further, it is preferable that the thickness of a layer of particles formed on the sleeve is one which can be thinned by a regulating plate sufficiently to be a uniform thickness, and the distance between the charging roller and the image carrier is 100–5000 μm. When the distance between the sleeve and the image forming object is smaller than 100 μm, it is difficult to form bristles of the magnetic brush which can cope with that distance for uniform charging and it is impossible to supply sufficient magnetic particles to the charging section, resulting in an impossibility of stable charging. When the distance exceeds 5000 μm by far, a layer of particles is formed coarsely to cause uneven charging to take place easily, and an effect of charge injection is lowered, resulting in an impossibility of sufficient charging. As stated above, when the distance between the sleeve and the image forming object takes an extreme value, it is impossible to make the thickness of a layer of particles on the charging roller appropriate for that distance. However, when the distance is within a range of 100–5000 μm, it is possible to make the thickness of a layer of particles appropriate for that distance. The basis for the foregoing is that a comet caused by rubbing of the magnetic brush can be prevented.

Incidentally, it is preferable that magnetic force on the sleeve of the aforementioned charging member is in a range of 500–1500 gauss.

A magnetic particles collecting member will be explained next, as follows. When a magnetic brush is used for the magnetic particles collecting member, the magnetic particles and the structure of a charging roller for magnetic particles are the same as those in a charging member. In the case of collecting member, however, it is preferable that the magnetic force on the sleeve is not less than 800 gauss for enhancing collecting efficiency, and it is preferable that the contact area between the image forming object and the collecting member is broadened by making the diameter of the collecting member large or by making the distance D between the image forming object and the sleeve small.

When a collecting member is one wherein a magnetic brush is not formed, magnetic particles on an image forming object are collected, for example, by a roll-shaped magnetic object that rotates while it is in contact with the image forming object. For preventing the image forming object from being damaged, therefore, slave operated rotation is preferable. In this case, magnetic force of 300 gauss or more is acceptable because of a direct action.

The aforementioned magnetic brush collecting member and magnetic object collecting member may take any one of collecting methods including a method wherein D.C. bias voltage of ±500–1000 V is impressed on both of them for collecting magnetic particles, a method wherein magnetic particles are collected under the floating state without impression of the D.C. bias voltage mentioned above, and a method wherein a collecting member is structured with an insulating substance for collecting magnetic particles.

Incidentally, a charging member and a collecting member are incorporated in a single casing to be close together and compact, and magnetic particles for a magnetic brush are electrically conductive. Therefore, there is a great fear that a phenomenon of electric leakage takes place between both members. Accordingly, it is preferable that an insulating shielding member is provided between both members.

Still another example of the invention will be explained as follows, referring to the drawings.

Figure 6:
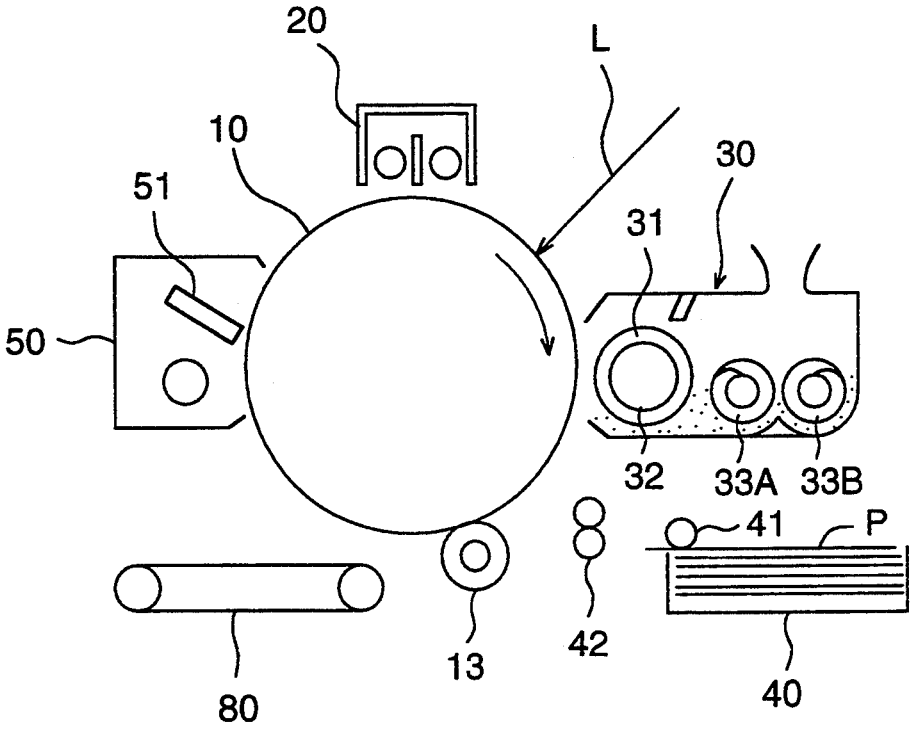
FIG. 6 is a schematic view showing the outline of an image forming apparatus equipped with a charging device of the invention.

FIG. 6 is a schematic view showing the outline of the structure of an image forming apparatus equipped with a charging device of the invention.

In the figure, the structure and operations excluding charging device 20 which will be described later are the same as those in FIG. 1.

Figure 7:
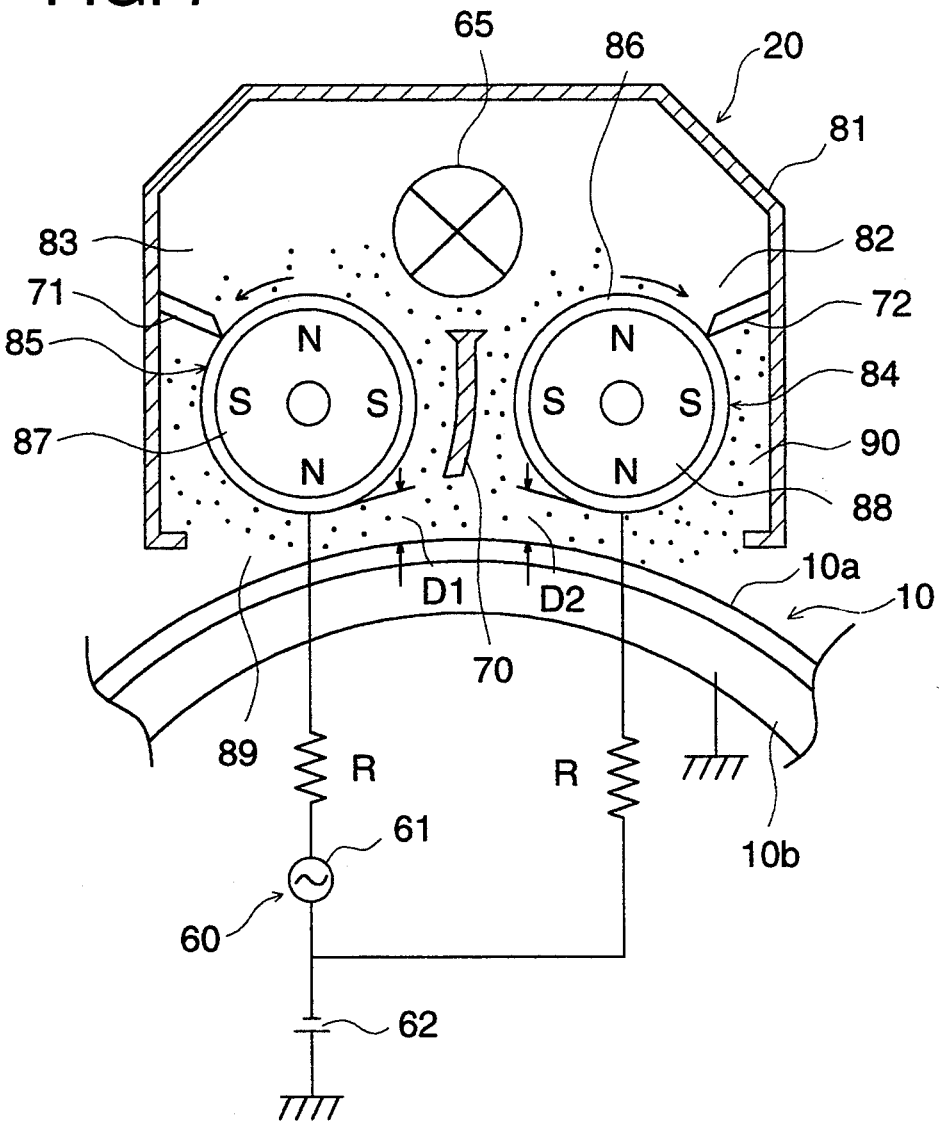
FIG. 7 is a schematic view showing another example of an charging device of the invention.

FIG. 7 is a sectional view showing another example of charging device 20 of the invention used for the image forming apparatus shown in FIG. 6. In the figure, the numeral 82 shows magnetic particles which are represented by coated spherical ferrite particles so that they may be electrically conductive. In addition to that, it is also possible to use conductive magnetic resin particles obtained through thermal kneading and crushing of the primary components of magnetic particles and resins. The conditions for better charging proved to include that a particle is prepared to be completely spherical in its external shape, prepared to be 50 μm in its particle size, prepared to be $10^8$ Ω·cm in its specific resistance, and an amount of frictional electrification under the condition of toner concentration of 1% is −5 μC/g.

The numeral 81 is a casing for charging device 20, and in the casing, there are incorporated charging member 83 and magnetic particles collecting member 84. The charging member 83 is composed of fixed magnetic object 87 having north and south poles alternately, sleeve 85 forced to rotate around the external surface of the fixed magnetic object in the arrowed direction (counterclockwise) at the speed which is 1.5 times that of photoreceptor drum 10, and magnetic brush 89, and magnetic force on the surface of the sleeve 85 of the magnetic object 87 is made to be 800 gauss. Distance $D_1$ between the sleeve 85 and the photoreceptor drum 10 is set to be 500 μm, and the distance $D_2$ is impressed with D.C. voltage of −800 V from D.C. power source 62 and impressed with A.C. voltage of $V_{p-p}$ 1200 V with 1 KHz from A.C. power source 61 that is superposed on the D.C. voltage. Through rubbing of the magnetic brush 89 regulated by layer thickness regulating member 71 for magnetic particle layers on the surface of photoreceptor drum 10, charges are injected in photoreceptor layer 10*a* of the photoreceptor drum 10 for negative charging (−700 V).

The charging member mentioned above is subjected to powerful injection of charges by means of an alternating electric field caused by high A.C. voltage. Therefore, uneven charging takes place and magnetic particles adhere to the photoreceptor drum in the vicinity of an outlet of a magnetic brush.

The phenomena of the uneven charging and adhesion of magnetic particles are eliminated by magnetic particle collecting member 84 in the following cycle.

The magnetic particle collecting member 84 mentioned above is composed, similarly to the charging member 83, of sleeve 86 that is forced to rotate around the external surface of fixed magnet object 88 having therein north and south poles alternately in the arrowed direction (counterclockwise) at the speed that is 1.0 time that of the peripheral speed of the photoreceptor drum, and of magnetic brush 90. Magnetic force on the surface of the sleeve 86 of the magnetic object 88 is made to be 1000 gauss. Distance $D_2$ between the sleeve 86 and the photoreceptor drum 10 is made to be 400 μm on which D.C. voltage of −800 V only is impressed from D.C. power source 62 of power source 60. Thereby, rubbing of the magnetic brush 90 regulated by layer thickness regulating member 72 on the photoreceptor drum 10 corrects the uneven charging on the photoreceptor and collects magnetic particles sticking to the photoreceptor drum.

Owing to the conditions that magnetic force applied on the magnetic brush of the collecting member mentioned above is relatively large, a scraping width to the photoreceptor drum 10 is large, and the collecting member 84 is rotated toward its inside, magnetic particles sticking to the photoreceptor drum are collected perfectly into the device. Further, since the magnetic brush is impressed only with D.C. voltage, gentle charging can be conducted for correcting uneven charging caused by the aforementioned charging member.

As stated above, a charging device shown in FIG. 7 can provide uniform charging free from both uneven charging and adhesion of magnetic particles.

Incidentally, the numeral 70 is an insulating shielding member provided for preventing occurrence of leakage phenomenon caused by difference in bias voltage condition between the charging member 83 and the collecting member 84. The numeral 65 is a stirring member for preventing deviation of magnetic particles.

Figure 8:
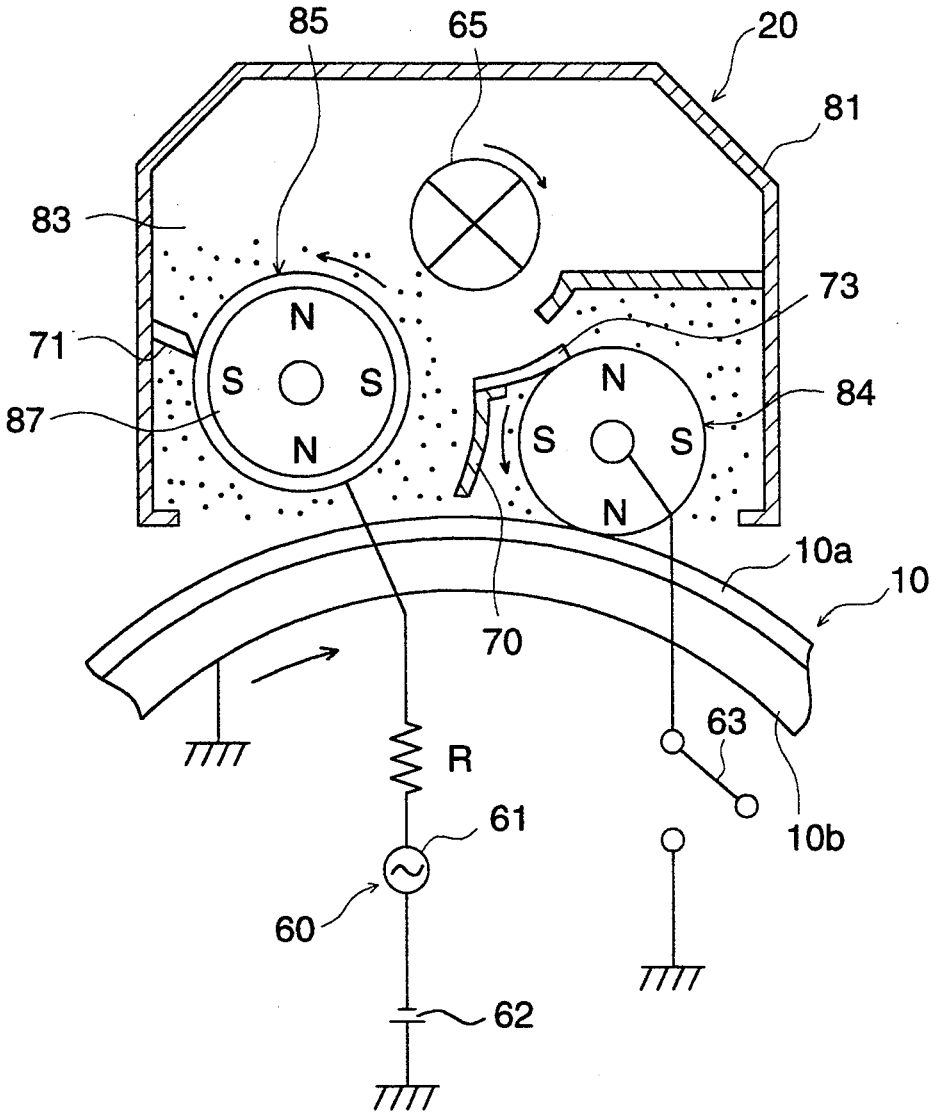
FIG. 8 is a schematic view showing still another example of an charging device of the invention.

FIG. 8 is a sectional view showing still another example of charging device 20 of the invention used in the image forming apparatus shown in FIG. 6. Items identical to those in FIG. 7 are given the same symbols.

Magnetic particles are made to be the same as those in FIG. 7, and charging member 83 and magnetic particle collecting member 84 are incorporated in a casing. With regard to the charging member, sleeve 85 is forced to rotate around the external surface of fixed magnetic object 87 at the speed that is 1.5 times that of the photoreceptor drum 10 as in the case of FIG. 7. Magnetic force of the magnetic object 87 on the surface of the sleeve 85 is made to be 800 gauss, and distance D between the surface of the sleeve 85 and the photoreceptor drum 10 is made to be 500 μm on which D.C. voltage of −800 V from D.C. power source 62 of power source 60 and A.C. voltage of $V_{p-p}$ 1000 V and 1 KHz from A.C. power source 61 are impressed.

The collecting member 84 mainly collects magnetic particles stuck to the photoreceptor drum 10 by the influence of the aforementioned charging member 83. Therefore, collecting member 84 composed of a rubber-made magnetic object with rubber hardness of 30°–70° having therein north and south poles alternately and having magnetic force of 1000 gauss at its surface is brought into contact with the photoreceptor drum 10 to be rotated thereby. When the collecting member is composed of a conductive member, it is either caused to be in a floating state by turning off changeover switch 63 of a ground terminal, or is impressed with D.C. voltage similarly to the occasion of charging, so that charges given by the charging member 83 may not be disturbed. The collecting member may also be composed of an insulating member. In this case, no grounding is needed because the collecting member is essentially in the state of floating. Incidentally, the numeral 73 is a scraper that scrapes off for collecting magnetic particles sticking to the collecting member 84. The numeral 65 is a stirring member for correcting deviation of magnetic particles, while, 70 is an insulating shielding member for preventing electrical leakage phenomenon occurring between the charging member 83 and collecting member 84 through conductive magnetic particles.

Owing to charging device 20 shown in FIG. 8, uniform and sufficient charging is given to the surface of a photoreceptor drum, and sticking of magnetic particles is completely prevented. In the following steps of imagewise exposure and development processing, therefore, image forming assuring high image quality can be attained.

In the present invention, no ozone is generated because of a charging system for injecting electric charges on a photoreceptor directly through a magnetic brush composed of magnetic particles, uniform and desired charging can be given, sticking of magnetic particles can completely be prevented, and thereby high image quality can constantly be assured because of a charging device with a built-in charging member and a built-in magnetic particle collecting member.

What is claimed is:

1. An image forming apparatus having an image forming body, comprising:

(a) magnetic particles;

(b) a carrying sleeve for carrying the magnetic particles, thereby for forming a magnetic brush on said carrying sleeve to charge said image forming body, said carrying sleeve being provided in the vicinity of said image forming body so that said magnetic brush comes into contact with said image forming body, said magnetic brush being in an alternating electric field and moving in accordance with the rotation of said carrying sleeve;

(c) a regulating member for regulating amount of passage of said magnetic particles between said regulating member and the surface of said carrying sleeve, wherein the following inequality is satisfied;

$$0.7\ DB \leqq DI \leqq 1.0\ DB$$

where DB represents the distance between said regulating member and the surface of said carrying sleeve, and DI represents the distance between the surface of said image forming body and the surface of said regulating member.

2. The image forming apparatus of claim 1, wherein the following inequality is satisfied;

$$0.2 \leqq DB \leqq 1.0\ \text{mm}.$$

3. The image forming apparatus of claim 1, wherein said carrying sleeve has a surface roughness of 10 to 25 μm.

4. The image forming apparatus of claim 1, wherein the moving direction of said magnetic brush is the same as that of said image forming body, and the following inequality is satisfied;

$$0.2\ V_I \leqq V_S \leqq 0.9\ V_I$$

where $V_S$ represents the moving speed at the leading edge of said magnetic brush on said carrying sleeve and $V_I$ represents the moving speed of the circumferential surface of said image forming body.

5. The image forming apparatus of claim 4, wherein the following inequality is satisfied;

$$0.3\ V_I \leqq V_S \leqq 0.5\ V_I.$$

6. The image forming apparatus of claim 1 further comprising a magnetic particle collecting member provided downstream of said carrying sleeve, and one of either means for applying a direct bias current to said magnetic particle collecting member or means for enabling said magnetic particle collecting member to be of floating condition.

7. The image forming apparatus of claim 6, wherein said magnetic particle collecting member has a magnetic intensity greater than that of said carrying sleeve.

* * * * *